United States Patent [19]

Schonfeld et al.

[11] 4,348,101

[45] Sep. 7, 1982

[54] DUPLEX PRINTING APPARATUS

[75] Inventors: Arnold Schonfeld, Norristown; Jules A. Eibner, Dresher; Franklin E. Bastian, North Wales, all of Pa.

[73] Assignee: Sperry Corporation, New York, N.Y.

[21] Appl. No.: 192,269

[22] Filed: Sep. 30, 1980

[51] Int. Cl.[3] ..... G03G 15/00

[52] U.S. Cl. ..... 355/14 R; 271/186; 271/DIG. 9; 355/3SH; 355/23

[58] Field of Search ..... 355/3 SH, 14 SH, 23, 355/24, 26, 14 R; 271/DIG. 9, 65, 186, 31

[56] References Cited

U.S. PATENT DOCUMENTS

| | | | |
|---|---|---|---|
| 3,318,212 | 9/1965 | Rubin . | |
| 3,506,347 | 4/1970 | Carlson . | |
| 3,536,398 | 10/1970 | Bhagat . | |
| 3,548,783 | 12/1970 | Knapp . | |
| 3,615,129 | 10/1971 | Drawe et al. . | |
| 3,630,607 | 12/1971 | Korn et al. . | |
| 3,645,615 | 2/1972 | Spear, Jr. . | |
| 3,671,118 | 6/1972 | Fantuzzo et al. . | |
| 3,672,765 | 6/1972 | Altmann . | |
| 3,687,541 | 8/1972 | Aser et al. . | |
| 3,697,171 | 10/1972 | Sullivan . | |
| 3,775,102 | 11/1973 | Punnett . | |
| 3,844,653 | 10/1974 | Kelly . | |
| 3,844,654 | 10/1974 | Guenther . | |
| 3,856,295 | 12/1974 | Looney . | |
| 3,862,802 | 1/1975 | Till . | |
| 3,866,904 | 2/1975 | Stemmie . | |
| 3,869,202 | 3/1975 | Tabata et al. | 355/3 R |
| 3,947,270 | 3/1976 | North . | |
| 3,972,612 | 8/1976 | Komori . | |
| 4,017,181 | 4/1977 | Komaba et al. . | |
| 4,046,471 | 9/1977 | Branham et al. | 358/300 X |
| 4,066,252 | 1/1978 | Wick | 271/DIG. 9 |
| 4,099,150 | 7/1978 | Connin | 355/23 X |
| 4,110,025 | 8/1978 | Tabata | 355/24 X |
| 4,136,862 | 1/1979 | Kunz et al. | 271/DIG. 9 |
| 4,140,387 | 2/1979 | Gustafson . | |
| 4,158,500 | 6/1979 | DiFrancesco et al. . | |
| 4,172,655 | 10/1979 | Wood | 355/26 |
| 4,174,905 | 11/1979 | DiFrancesco et al. . | |
| 4,186,662 | 2/1980 | Borneman | 271/DIG. 9 |
| 4,191,465 | 3/1980 | Boase et al. | 355/24 X |
| 4,214,831 | 7/1980 | Reesen | 355/24 X |
| 4,218,128 | 8/1980 | Satomi et al. | 355/24 X |
| 4,253,759 | 3/1981 | Rattin | 271/3.1 X |
| 4,264,183 | 4/1981 | Stoudt | 355/3 SH |
| 4,264,187 | 4/1981 | Rhodes | 355/3 SH |
| 4,278,344 | 7/1981 | Sahay | 271/3.1 X |
| 4,291,970 | 9/1981 | DiFrancesco | 355/3 SH |

*Primary Examiner*—Richard L. Moses

*Attorney, Agent, or Firm*—James R. Bell; Marshall M. Truex

[57] ABSTRACT

A duplexing apparatus for printing data or information on both sides of a sheet of paper to be used with laser printers or paper copiers is disclosed. Sheets of paper are fed from a paper feeding station for presentation to an image transfer station. The image transfer station transfers toned images, present on a photosensitive member, to the sheet of paper. After the transfer, the paper is moved along a discharge path to a duplex device which is disposed in close proximity to the paper feeding station. The duplex device engages the sheet of paper leaving the transfer station and either discharges the paper if printing is done thereon to a discharge station or returns the sheet of paper to the paper feeding station for a second presentation to the transfer station for duplex printing. Coded pagination information is sensed and sent to a microcontroller which checks the data to confirm that the pages of data on each of the sheets are being printed in the proper order. In one mode of operation, the second side of a sheet of printing is provided during the first presentation of a sheet of paper to the transfer station and then on the subsequent presentation the first side of printing is placed on the sheet of paper. This procedure cooperates with a curved portion of the discharge path occurring between the duplex device and the discharge station to place the first side of printing on the sheets of paper face down and in proper order in the discharge station.

8 Claims, 10 Drawing Figures

| MICROSWITCH SIGNAL No. | PAPER FEED STATION | SHEET/PAGE | DUPLEX ROLLER DIRECTION | DISCHARGE |
|---|---|---|---|---|
| 1 | 72 | 1/2 | F | — |
| | | | F | — |
| 2 | — | — | F | — |
| | | | F | — |
| 3 | 72 | 2/2 | F | — |
| | | | R(1) | — |
| 4 | 70 | 1/1 | F | — |
| | | | F | — |
| 5 | 72 | 3/2 | F | — |
| | | | R(2) | — |
| 6 | 70 | 2/1 | F | — |
| | | | F | 1 |
| 7 | 72 | 4/2 | F | — |
| | | | R(3) | — |
| 8 | 70 | 3/1 | F | — |
| | | | F | 2 |
| 9 | 72 | 5/2 | F | — |
| | | | R(4) | — |
| 10 | 70 | 4/1 | F | — |
| | | | F | 3 |
| 11 | 72 | 6/2 | F | — |

Fig. 8

DUPLEX PRINTING APPARATUS

BACKGROUND OF THE INVENTION

This invention relates to printing of data or information on both sides of a sheet of paper, that is, duplex printing.

Considerations of the cost of paper and convenience of handling make duplex printing desirable in copiers and non-impact printing apparatuses. In laser non-impact printers where high speed printing is an objective, it is particularly important that the inclusion of a duplex printing feature results in little or no reduction in the speed of printing. Simplicity and reliability in design for low cost production and operation are important for both copiers and laser printers.

U.S. Pat. Nos. 3,318,212; 3,536,389; 3,548,783; 3,671,118; 3,687,541; 3,697,171; 3,775,102; 3,844,653; and 3,844,654 relate to duplex copiers employing at least two separate transfer means for imaging information on both sides of a sheet of paper. The use of more than one transfer means results in higher expense and larger size.

U.S. Pat. Nos. 3,506,347; 3,615,129; 3,630,607; 3,645,615; 3,672,765; 3,856,295; 3,862,802; 3,866,904; 3,869,202; 3,947,270; 3,972,612; 4,017,181; 4,140,387; 4,158,500; and 4,174,905 relate to duplex copiers employing paper handling mechanisms for inverting the paper and presenting it to the transfer means portion of the copier a second time for duplex printing. Such mechanisms usually involve tortuous paper handling paths which result in greater complexity, and which can be inconsistent with high speed printing.

Immediate detection of paper misfeeds in copiers and particularly in very high speed laser printers employing duplex printing is important in avoiding embarrassing lack of correlation between a page of printing and pagination. It is also desirable for avoiding loss of time and waste of paper.

SUMMARY OF THE INVENTION

The present invention comprises a duplexing apparatus for printing information or data onto both sides of a sheet of paper. The duplexing apparatus can be used either with a non-impact printer such as a laser printer or with a paper copier. In either instance a photosensitive surface capable of storing images is exposed by an exposure means in accordance with information to be copied or printed. The copier or laser printer also includes a transfer means for transferring a data image from the photosensitive member to one side of a sheet of paper at a time.

A paper feeding means for feeding a sheet of paper from a paper feeding station presents the sheet of paper to the transfer means by moving the sheet of paper along a paper feeding path. As the paper feeding means moves a sheet of paper past the transfer means the data imaged on the photosensitive member is transferred to the first side of the sheet of paper. If no more printing is required on the sheet of paper, it is passed to a discharge station, the discharge station lying at the end of the paper discharge path.

A duplex means which is disposed in close proximity to the paper feeding station is used to discharge the sheets of paper to the discharge station when the printing on a selected sheet of paper is finished. The duplex means also acts to deposit sheets of paper having printing on one side and selected for duplex printing back into the paper feeding station. The paper when deposited into the paper feeding station by the duplex means is inverted from its original state in the paper feeding station, that is, its state before its first presentation to the transfer means. Hence, when the sheet of paper selected for duplex printing, containing one side of printing thereon, is presented a second time to the transfer means, data is imaged by the transfer means (from the photosensitive member) onto the blank side of the sheet of paper selected for duplex printing.

The duplex means comprises a propelling means which engages and moves sheets of paper along either a portion of the discharge path or along a return path into the paper feeding station. The propelling means is disposed between the portion of the discharge path on one side and both the transfer means and the paper feeding station on the other side.

The duplexing apparatus when used with a laser printer prints data on first and second sides of a plurality of sheets of paper in a predetermined order. The sheets of paper are presented to the transfer means first and second times. The data transferred to the sheets of paper includes pagination data for each of the plurality of the sheets of paper. The laser printer further comprises sensing means for sensing the pagination data on the sheets of paper and stopping the printing process when the presentation of the sheets of paper deviates from the predetermined order.

In one mode, when performing duplex printing on a plurality of sheets of paper in series, the second side of a sheet of paper is printed on during the first presentation to the transfer means while the first side is printed on during the second presentation. This is generally not a problem for laser printers where the data originates from a data processing source and is stored in page buffers before printing.

Other objects, features and advantages of the present invention will become more fully apparent from the following detailed description of the preferred embodiment, the appended claims and the accompanying drawings in which:

FIG. 8 is a table summarizing operation of the present invention in a preferred embodiment duplex printing mode.

DETAILED DESCRIPTION OF THE DRAWINGS

Figure 1:
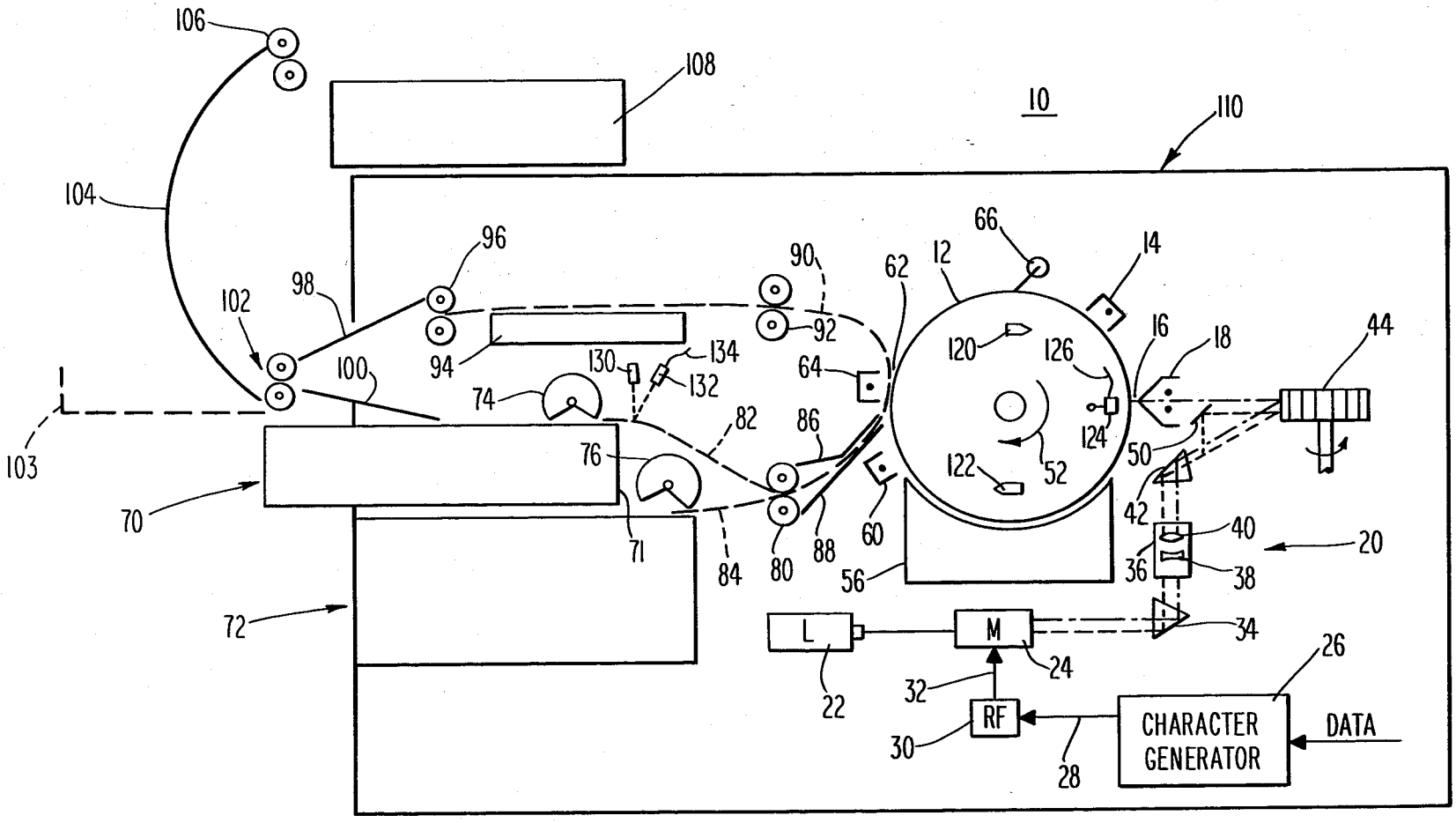
FIG. 1 is a preferred embodiment block diagram of the present invention.

Referring to FIG. 1, a block diagram of a laser printer designated generally 10 for printing data on both sides of a sheet of paper is shown. The laser printer 10 comprises many of the components of a conventional plain paper copying machine except that the preferred embodiment laser printer uses an image development process that is the reverse of some plain paper copiers (reversal development). It is the reversal development process that will be described herein but this invention is in no way limited to the polarity of the development system chosen. One such plain paper copier suitable for use in the preferred embodiment of the present invention (if modified for reversal development) is disclosed in U.S. Pat. No. 3,972,612, which is incorporated by reference as if specifically set forth herein. Other plain paper copiers such as xerographic copiers varying in detail but comprising the essential components of a plain paper copier are also suitable for use in the preferred embodiment of the present invention.

In general, the laser printer comprises a photosensitive member such as the rotatable cylindrical photoconducting drum 12. In the example of FIG. 1, a corotron 14 produces a positive charge on photoconducting drum 12 as it rotates by there. That portion of the photoconducting drum 12 passing by the exposure station 16 is illuminated by a light source 22 along a linear region parallel to the axis of the photoconducting drum 12, and an AC charge is simultaneously supplied to the photoconducting drum at the exposure station by AC corotron 18. In the preferred embodiment photoconducting drum 12 comprises an innerconducting base layer, an intermediate photoconducting semiconductor layer and an outer insulating layer. When the positive charge from corotron 14 is placed on the surface of the outer insulating layer, a negative charge is induced and trapped at the boundry between the intermediate semiconductor layer and the outer insulating layer. Light from the light source impinges selected areas of the photoconducting drum in accordance with the desired image to be placed thereon. Wherever light impinges upon the photoconducting drum, the intermediate photoconducting layer conducts the negative charge from the boundary to the base layer. At the same time, the AC discharge neutralizes the positive charge on the surface of the outer insulating layer which facilitates the conduction of the negative charge from the boundary to the base layer. In fact the AC corotron results in a net negative charge formed on the insulating surface in the so called discharged area. In those regions on the surface of the photoconducting drum where no light occurs, the negative charge at the boundary remains fixed and the neutralizing effect of the AC corotron on the positive surface charge on the outer insulating layer is diminished by the trapped negative charge at the boundary.

In the preferred embodiment laser printer, exposure of the photoconducting drum is provided by a scanning laser system designated generally 20. Wherever the light from the scanning laser beam impinges on the photoconducting drum, the drum is discharged leaving an electrostatic image thereon. In the plain paper copier of U.S. Pat. No. 3,972,612, a scanning laser system is not used to illuminate the photoconducting drum. Rather the image of an original document to be copied is illuminated by a light source and reflected through an optical system through a slit onto the photoconducting drum 12. Depending on the nature of the photoconducting drum 12 (p-type or n-type semiconductor with or without an outer insulating layer) a negative corotron can be used in place of positive corotron 14 and the need for an AC corotron 18 is not always required.

The scanning laser system 20 comprises a laser light source 22 which transmits a collimated light beam to a light beam modulator 24. Alphanumeric characters are stored as data bits, ones or zeroes, in character generator 26. Ones are transmitted as high signals over line 28 to RF generator 30. In response to the high signals RF generator 30 transmits an RF voltage over line 32 to light beam modulator 24, otherwise no RF voltage is transmitted.

Light beam modulator 24, in the preferred embodiment, is an acousto-optical modulator such as a modulator made by Coherent Radiation Company, Model No. 305. The light beam modulator 24 acts in response to RF voltages and establishes acoustic vibrations which cause a portion of the collimated light beam to be diffracted through an angle along a deflected path. Together, the deflected portion and remaining undeflected portion form a modulated light beam.

The modulated light beam impinges upon prism 34 where its direction is changed to pass through an optical lens system 36 comprising a negative lens 38 and a positive lens 40. These lenses cooperate together to control the size and focus of the modulated light beam. After passing through optical system 36 the direction of the modulated light beam is again changed by prism 42 whereupon the modulated light beam impinges on rotating polygonal mirror 44 which imparts the sweeping motion to the laser light beam. The rotating reflection mirror 44 reflects the modulated light beam toward photoconducting drum 12. The rotating reflection mirror causes the modulated light beam to sweep repeatedly in fan-like fashion. In the preferred embodiment, only the deflected portion of the light beam is enabled to impinge upon the surface of the photoconducting drum 12. When ones stored in the character generator memory are transmitted as high signals to RF generator 30, RF pulses are transmitted to light beam modulator 24 which in turn creates the deflected portion of the light beam. When this occurs light impinges on the photoconducting drum 12 to discharge it and to image electrostatically a dot thereon. The undeflected portion of the light beam is never permitted to strike photoconducting drum 12. A suitable reflecting mirror 50 is shown schematically in FIG. 1 to reflect the undeflected portion of the modulated light beam away from the photoconducting drum 12.

The preferred process of electrostatically imaging original data on a substantially uniformly charged photoconducting surface as described above is the reverse of some laser printers where the light impinging on the drum discharges the background of the image leaving the image of the original data as a charged area of the drum. In our system the discharged area represents the data.

Photoconducting drum 12 is caused to rotate in the direction of curved line and arrow 52 while the periodically sweeping laser beam traverses a series of parallel straight lines across the surface of the drum. The straight lines are parallel to the axis of the drum and represent lines of data to be imaged on the sheet of paper.

At the exposure station 16 the light transmitted, from rotating mirror 44 in the case of the laser printer or from an optical system as described in U.S. Pat. No. 3,972,612 in the case of a plain paper copier, causes data to be imaged on the photoconducting drum 12 in the form of electrostatic charges. As the portion of the drum with the electrostatic images rotates, it passes by a developing station which comprises a container 56 which contains a developing solution. The developing solution is pumped onto the photoconducting surface and electrically charged toner material therein adheres to the electrostatic image formed on the drum to thereby develop the image. In the preferred embodiment, using reversal development, a positive corotron 60 removes excessive developing solution from the photoconducting drum 12 without disturbing the toner image.

In the reversal development process being described herein, positively charged toner material adheres to the discharged area of the drum. The term discharged as used in this context means that the originally formed uniform positive charge is discharged by the writing in the presence of an AC corotron leaving behind a negative charge in the discharged area due to the AC corotron in a manner as described earlier.

The photoconducting drum 12 with the toned image is then rotated past transfer station 62 where the image on the photoconducting drum 12 is transferred to a sheet of paper passing through the transfer station 62, the transfer occurring because of the voltage of the negative corotron 64. Hence, as a sheet of paper passes by the photoconducting drum 12 at transfer station 62 negative corotron 64 acts as a transfer means for transferring the data image on the photoconducting drum to one side of the sheet of paper. As the drum continues to rotate the remaining toner left on the photoconducting drum and the developing solution are wiped away from the drum by the edges of a wiper 66. Positive corotron 14 again applies a uniform positive charge to the photoconducting surface of drum 12 which is then ready for illumination at exposure station 16 for imaging of new data.

Sheets of paper are held or stored in paper feeding stations 70 and 72. Operation of the present invention can be accomplished with only one paper feeding station such as paper feeding station 70, but in the preferred embodiment two paper feeding stations are provided.

A sheet of paper is removed from a paper feeding station by activating one of the cammed rollers 74 or 76. As the cammed roller 74 or 76 rotates the outer circumference portion engages the top sheet of paper in the paper feeding station 70 or 72 and moves the paper from the paper feeding station into the pinch roller assembly 80 along dashed paths 82 or 84 respectively. The pinch roller assembly 80 is in constant rotation and engages the paper to propel it through the channel formed by paper guides 86 and 88. The paper guides 86 and 88 guide the paper to the transfer station 62 where, through the action of the negative corotron 64, the image on the photoconducting drum 12 is transferred to one side of the paper. The dashed line 82 or 84 along with the dashed line within the channel formed by guides 86 and 88 define a paper feeding path from the paper feeding station 70 or 72 to the transfer station 62.

The dashed line 90 shows the continuation of the path followed by the paper as it leaves the transfer station 62 propelled by roller 92. There are several means known in the art for guiding the paper away from the photoconducting drum 12 along path 90. U.S. Pat. No. 3,972,612 describes such a means by use of a separation belt (25 in U.S. Pat. No. 3,972,612) and a series of turning pulleys. The paper is propelled by roller 92 across a heated platen 94 where the toner is fused to the sheet of paper to permanently fix the image thereon.

After leaving the heated platen 94, the sheet follows a discharge path and is engaged by constantly turning pinch roller assembly 96. As the paper leaves pinch roller assembly 96 it contacts deflection plate 98 and then contacts return plate 100 which guides the paper into duplex roller assembly designated generally 102. The front edge of the sheet of paper is engaged by duplex roller assembly 102 before the back edge of the sheet of paper leaves pinch roller assembly 96. This ensures a positive propulsion of the paper from pinch roller assembly 96 through the contact with the deflection plate 98 and return plate 100 until it is engaged by duplex roller assembly 102.

If printing on the sheet of paper is finished (that is, if both sides of the sheet have been printed, or if only one side is printed but the other side was not to be printed) duplex roller assembly 102 continues to rotate in a direction which propels the sheet of paper along a remaining portion of the discharge paper path, the remaining portion defined by curved discharge plate 104. As the sheet of paper is guided by discharge plate 104 it is engaged by rotating roller assembly 106 which in turn propels the paper through the roller assembly into the discharge station formed by paper cassette 108. The distance between duplex roller output assembly 102 and roller assembly 106 along discharge plate 104 is less than a page length to assure that the paper is engaged by roller assembly 106 before it leaves duplex roller assembly 102.

If it is desired to print on both sides of the sheet of paper, then a sheet of paper which has passed by the transfer station one time to receive printing on one side is received by duplex roller assembly 102 which rotates for a short time in a direction propelling the sheet of paper toward discharge station 108. This assures that the sheet of paper is no longer in contact with roller assembly 96. However, before the sheet of paper moves entirely through duplex roller assembly 102, the duplex roller assembly is reversed in direction propelling the paper along return plate 100 into the paper feeding station 70. The distance between duplex roller assembly 102 and the front edge 71 of paper feeding station 70 is slightly larger than a sheet length to assure that a sheet is fed all the way into the paper feeding station 70. Note that the printing present on the first side of the sheet of paper is now facing in an upward direction in paper feeding station 70 so that when the sheet of paper with printing on the first side is removed from the paper feeding station 70 by cammed roller 74 along the paper feeding path partially formed by dashes line 82 and then through the channel formed by guides 86 and 88, the unprinted side of the paper will be presented to the surface of the photoconducting drum 12 to receive an image thereon.

In high speed printing a series of sheets of paper are passing through the printing mechanism at any one time with only a small separation between them, e.g., one and a quarter centimeters (approximately one half inch). As a sheet of paper requiring second side printing leaves roller assembly 96, duplex roller assembly 102 reverses. Duplex roller assembly 102 must deposit this sheet of paper in paper feeding station 70 and be prepared to accept the next sheet of paper from roller assembly 96. If the next sheet of paper is to be discharged the roller assembly 102 is again reversed in direction. In the preferred embodiment duplex roller assembly rotates at a faster speed than roller assembly 96 to accomplish this.

FIG. 1 shows the outline of a frame designated generally 110. The side walls of the frame are not shown in FIG. 1 but in one embodiment of a laser printer or plain paper copier the photoconducting drum and various roller assemblies are supported by axles or rods which run between and are supported by the sides of the frame 110. Photoconducting drum 12 is rotated by a conventional motor and chain drive assembly. The various roller assemblies are driven off the same motor driving force through subsidiary chain drive arrangements. As the photoconducting drum rotates continuously the various chain drives will also rotate continuously. With some of the roller assemblies it is not desirable to rotate the rollers continuously such as rollers 74 and 76. In these instances, a clutching arrangement can be utilized to activate rotation of the rollers when desired.

Figure 2:
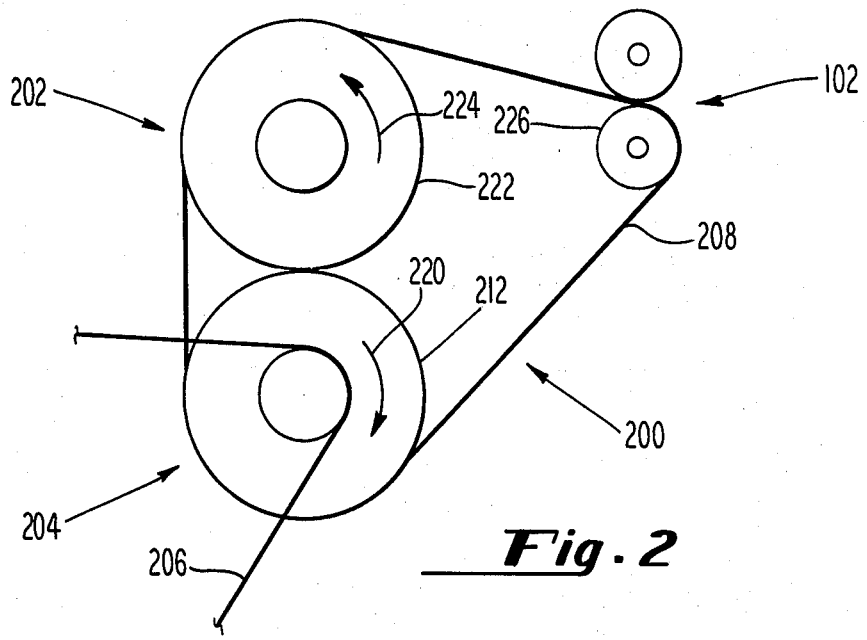
FIG. 2 is an enlarged elevational view of a portion of FIG. 1 including a portion not shown in FIG. 1.
Figure 3:
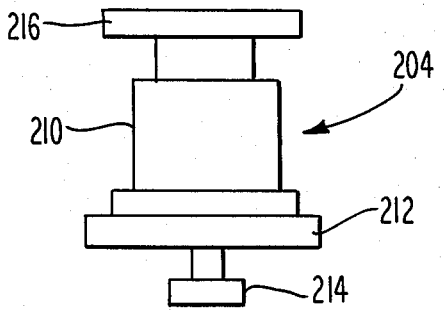
FIG. 3 is a top planar view of a portion of FIG. 2.

FIG. 2 shows a driving arrangement designated generally 200 for driving the duplex roller assembly designated generally 102 in forward or reverse directions. The drive assembly 200 comprises two electromagnetic clutch assemblies designated generally 202 and 204 (made by Ogura Clutch Company, Model No. OTCD-10) and chain drives 206 and 208. FIG. 3 shows electromagnetic clutch assembly 204 in more detail. It comprises a cylindrical electromagnetic clutch body 210, a drive gear 212 attached to one end of the clutch body 210 and concentric therewith, an input drive gear 214 attached to the drive gear 212 and concentric therewith and a sprocket 216 attached to the opposite end of the electromagnetic clutch body 210 from the drive gear 212 and concentric with the clutch body 210. Sprocket 216 is forced to rotate in the direction of drive gear 212 only when the electromagnetic clutch within clutch body 210 is activated, otherwise it is free to rotate in either direction.

Referring once again to FIG. 2, as drive chain 206 moves it rotates the drive gear 212 in the direction of curved line and arrow 220. Drive gear 212 engages drive gear 222 on electromagnetic clutch assembly 202 causing it to rotate in the opposite direction, i.e., in the direction of curved line and arrow 224. A subsidiary drive chain 208 is connected to the sprockets of electromagnetic clutch assemblies 202 and 204 and also to an input gear on duplex roller assembly 102. Depending on which electromagnetic clutch is engaged the drive chain 208 will rotate the roller 226 of duplex roller assembly 102 in one direction or the other. For example, if clutch assembly 204 is engaged then sprocket 216 will rotate in the direction of curved line and arrow 220 (clockwise) forcing the roller 226 to rotate in a clockwise direction also. Alternatively, if the electromagnetic clutch 202 is engaged then the sprocket associated with that clutch will rotate the roller 226 in the opposite or counter-clockwise direction.

In the preferred embodiment of FIG. 1, photoconducting drum 12 is adapted to receive two pages of information for each complete rotation of the drum, that is, for each half rotation of the drum a full page of data is imaged by the laser printer on a half of a circumference of the drum 12. Cams 120 and 122 are attached to the side of the drum and as they rotate past microswitch 124 they activate the switch sending a signal out over line 126 to the laser printer controller designated generally 500 in FIG. 5. One of the functions of the controller 500 is to synchronize the imaging of data on the drum, the feeding of sheets of paper, and the rotation of the drum. The controller 500 comprises a microcontroller 502 which is capable of being programmed. The signals from microswitch 124 are transmitted to the controller 500 and are used as timing signals for the microcontroller. The program within the microcontroller generates data for the controller 500 which in response activates one of the rollers 74 or 76 to feed the sheet of paper into the paper feeding means along the feed path to the transfer means. Printing is placed on one side of the sheet of paper as described above and the sheet of paper is moved along the dashed path 90 over the fuser or heating platen 94 through roller assembly 96 where it is deflected by deflection plate 98 and by return plate 100 into the duplex roller assembly 102. If this is a sheet of paper requiring duplex printing then the controller 500, in response to the program, reverses roller assembly 102 propelling the sheet of paper into the paper feeding station 70. After an appropriate time, the controller 500 in response to the program activates roller 74 to feed the sheet of paper back into the paper feed path for printing on the second side.

Figure 5:
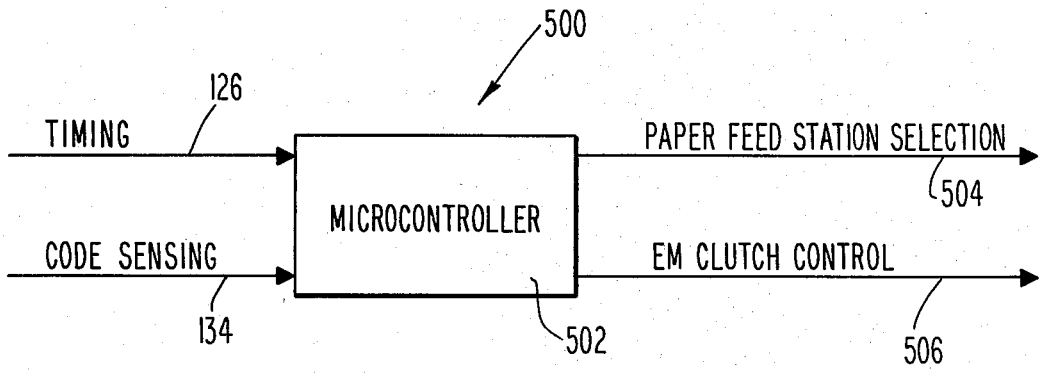
FIG. 5 is a preferred embodiment block diagram schematic of the control portion of the invention of FIG. 1.

FIG. 5 is a circuit schematic of the controller 500 of the laser printer of FIG. 1. It shows microcontroller 502 which in the preferred embodiment is an Intel 8748 microprocessor. The microcontroller 502 receives timing signals over line 126 from the microswitch 124. It uses these timing pulses to synchronize an internal timing clock contained within the microcontroller 502. The microcontroller uses the synchronized clock to execute a program which provides the proper signals to drive the duplex roller assembly 102 and the feed rollers 74 and 76 at the appropriate times. Microcontroller 502, sends signals over paper feed station selection line 504 to rotate either roller 74 or roller 76 depending on which paper feed station is to be used. One manner in which this might be accomplished is for the microcontroller 502 to furnish a selection signal to a relay and when a timing signal is received from the microswitch 124 directly at the relay a solenoid is activated to engage a clutch to drive either roller 74 or 76 depending on which selection was made by the microcontroller 502. These details are not shown in FIG. 1 since they are well known to one of ordinary skill in the art. Further, it is not the only way in which roller 74 and 76 could be activated.

When printing a plurality of sheets of paper in a duplex printing mode, duplex roller assembly 102 will rotate first in one direction and then in the other alternately to furnish sheets of paper with duplex printing thereon to discharge station 108 or to deposit sheets of paper with printing on only one side into paper feed station 70 where duplex printing can be completed. This is accomplished through the microcontroller 502 by sending signals at the appropriate time over the electromagnetic clutch control line 506 to the electromagnetic clutch assemblies 202 or 204 in FIG. 2.

FIG. 8 is a table showing the sequence of operation of the laser printer and duplex mechanism of FIG. 1 in cooperation with the signals from the microcontroller circuit of FIG. 5. Column 1 shows a series of output signals from the micro switch 124 located near photoconducting drum 12 and activated by the cams 120 and 122. There are two output signals from the microswitch for each complete revolution of the photoconducting drum. Column 2 shows which paper feed station, 70 or 72, is being used to supply sheet of paper for movement past the transfer station 62. Column 3 shows which sheet of paper in a series is being sent to the transfer station 62 relative to the microswitch signal number and which side of the sheet of paper is being printed on. For example, page 2 of a sheet of paper means the second side or side with the higher page number as that sheet of paper would appear in a sequence of pages in a report for example. A one means that this is the first side of the sheet of paper which would be seen in a report. Column 4 shows in which direction the duplex assembly roller 102 is rotating, e.g. forward to discharge, reverse for duplex printing. Finally, column 5 shows when the various sheets of paper arrive in the discharge station relative to the microswitch signal number and the other events.

FIG. 8 is only one example of the manner in which the laser printer may be operated. It is not necessary for example, to select sheets of paper from both paper feed stations 70 and 72. Duplex printing can be accomplished by always selecting the paper from the paper feeding station 70. Of course duplex printing can not be provided by accessing paper only from paper feed station 72 since the duplex roller assembly 102 only furnishes paper to paper feed station 70.

Refer now to FIGS. 1,5, and 8, and note that at the beginning of the duplex printing of a plurality of sheets of paper, with the occurrence of the first microswitch signal from microswitch 124, the roller 76 for paper feed station 72 is activated and the first blank sheet of paper is moved toward the transfer corotron 64 for the printing of the second page of data on that sheet. Nothing else occurs until the third microswitch signal is transmitted and once again the blank piece of paper is furnished from paper feed station 72. This is the second sheet and will receive a second page of printing by the transfer corotron 64. Between the occurrence of the third and fourth microswitch signals sheet number one has arrived at the duplex roller assembly 102 (this corresponds to approximately, one and a quarter rotations of the photoconducting drum from the time that sheet number one first began to move from the paper feeding station 72). Since it is desired to print on the remaining side of sheet number one the rollers are reversed under the control of the microcontroller and the first sheet of paper is deposited in the feed station 70. Because of the arrangement of the paper path and the paper feed station 70 the printing which has already occurred on sheet number one will be facing the roller 74. The duplex roller assembly 102 is only reversed in direction for a short period of time and then it resumes its normal forward direction of rotation. In order to accommodate the proper timing the duplex rolles 102 may operate at a speed which is different from the roller assemblies 80, 92 and 96.

When microswitch signal number four occurs, microcontroller 502 sends a signal to roller 74 and the first sheet which has just been deposited in paper feeding station 70 is propelled from the paper feeding station along the paper feed path 82 to the roller assembly 80. This sheet of paper will receive printing on the remaining blank side of the sheet. Even though this is the second pass by the transfer station 62 the first or earlier side of printing is placed on the sheet.

At microswitch signal number five, the microcontroller once again switches to paper feed station 72 and sheet number three is furnished to the transfer corotron 64. Beween microswitch signals five and six the duplex roller assembly 102 is again reversed in direction in order to deposit sheet number two in paper feed station 70. Immediately after this, microswitch signal number six occurs and the second sheet is furnished to the transfer corotron a second time. Between microswitch signals six and seven, sheet number one with printing on both sides is discharged from the laser printer through the duplex roller assembly 102 along the paper discharge path formed by curved discharge plate 104 to discharge rollers 106 where it is deposited in paper discharge station 108. Because of the nature of the paper feed path 90 and the shape of curved discharge path 104, and because the first page of printing is placed on the sheet of paper during the second pass by the transfer corotron 64, the discharge of the sheet will occur in the paper feeding station 108 with the first page of printing face down. Subsequent sheets of paper discharged from the laser printer will occur in like manner so that when the stack of discharged papers are removed from the discharge station, the pages will be in a proper numerical order.

Referring once again to FIG. 8 it can be seen that except for the initial two or three microswitch signals, the laser printer under the control of the microcontroller will alternately furnish sheets of paper from the paper feed station 70 and 72 and will periodically reverse rotation of the duplex rollers to deposit a sheet of paper into paper feeding station 70 for duplex printing and then to discharge a sheet of paper with completed duplex printing into the discharge station 108. FIG. 8 carries the example far enough to show the first three sheets of paper being discharged with duplex printing thereon. It should be understood that a similar procedure to the start-up procedure described herein is performed in reverse at the end of a sequence of duplex printing.

If the laser printer is to be used only in the duplex mode then the curved discharge plate 104 and output cassette 108 can be replaced with the dotted paper output cassette 103 which is adjacent to duplex roller assembly 102. The same procedure outline for FIG. 8 will be followed in printing a series of sheets of paper in duplex mode except that the microcontroller 500 will be programmed to print the first page of a sheet during the first presentation of the sheet of paper to the transfer station and then the second page during the second presentation. The sheets of paper will be deposited directly into the paper output cassette 103 such that the pages will be in a proper numerical order. The advantage of the curved discharge plate 104 is that during simplex mode printing (or simplex copying if a plain paper copier is being used) the sheets of paper discharged along plate 104 will be deposited in paper output cassette 108 with the printed side down. The purpose of programming the microcontroller 500 to print the second page of a sheet during the first presentation at described in connection with FIG. 8 is to accommodate the sheet turnaround performed by the curved discharge plate 104 when the printer is used in the simplex printing mode.

Figure 4:
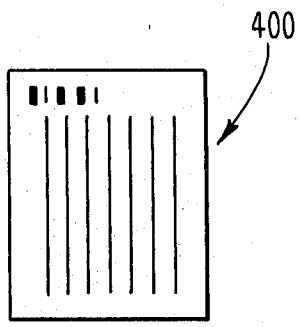
FIG. 4 is a representation of a printed page of data on a sheet of paper comprising a pagination code.

The present invention further comprises means for checking that the printing is taking place in the proper sequence. Coded pagination data is printed on each sheet of paper as it passes by the transfer corotron for the first time. When the sheet of paper is then furnished from the paper feeding station 70 with the printing from the first pass by the transfer corotron 64 facing up the coded pagination data passes under a beam of light from a light source 130. The light is reflected from the coded pagination data and detected by photoconductor 132 and transmitted via line 134 to the microcontroller 502. The microcontroller checks the coded pagination data to be sure that the proper sheet is being fed to the transfer corotron 64 in the proper sequence. The microcontroller knows which sheet of paper is next in accordance with the predetermined arrangement such as the one described in FIG. 8. If the proper sheet of paper is not being furnished to the transfer corotron in the proper sequence then the operation of the laser printer is automatically terminated so that a correction can be made. FIG. 4 is a representation of a sheet of printed data with a coded pagination indicated by the short thick and thin series of lines designated generally 400.

Figure 6:
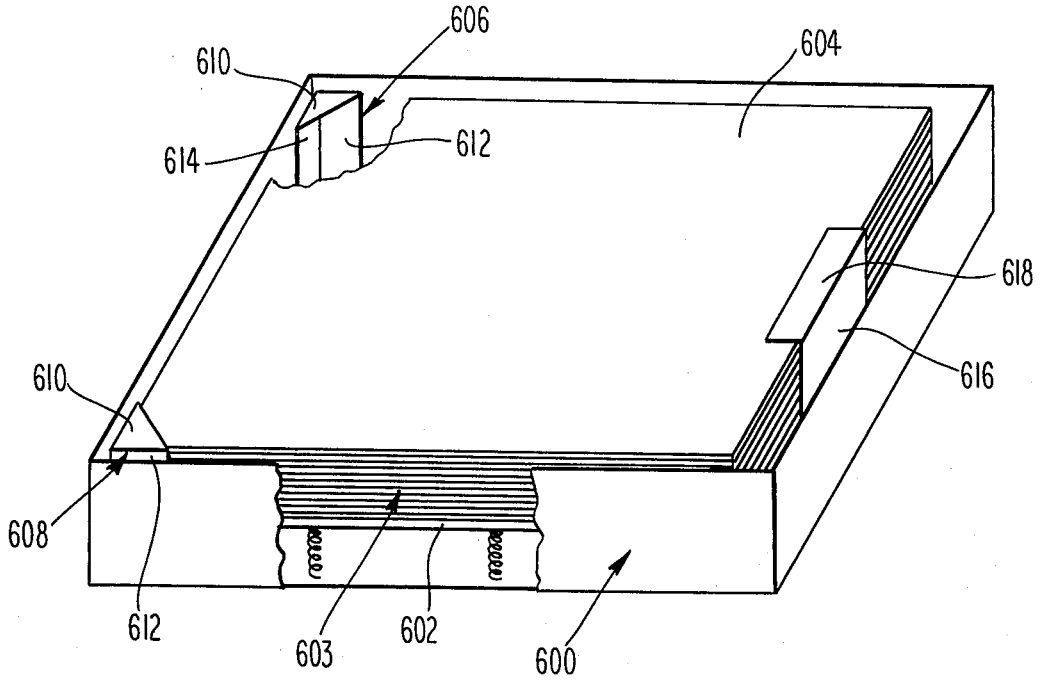
FIG. 6 is an enlarged view of a portion of FIG. 1 for holding sheets of paper.

FIG. 6 shows a paper feeding station comprising a cassette designated generally 600 having a spring loaded support plate 602 on which a stack of paper designated generally 603 is placed. The top sheet of paper in the stack is designated 604. The cassette comprises corner guides designated generally 606 and 608. Each corner guide comprises a top section 610, a side section 612 and a front section 614. The cassette also comprises a back guide 616. The stack of paper including the top sheet 604 is placed in the cassettes so that the paper is under the top sections 610 of the corner guides and the top section 618 of the back guide.

The corner guides 606 and 608 and back guide 616 tend to align and confine the paper in the cassette 600. When the rollers 74 or 76 rotate to move the top page 604 forward for printing, the top page must overcome the restraining forces of the front surfaces 614 of the corner guides. There is not, however, enough friction between the remaining pages in the stack and the top page 604 to drive the second sheet forward against the restraining force of the front section 614. Therefore, the second page remains in place in the cassette 600 and the first page is driven off.

Figure 7:
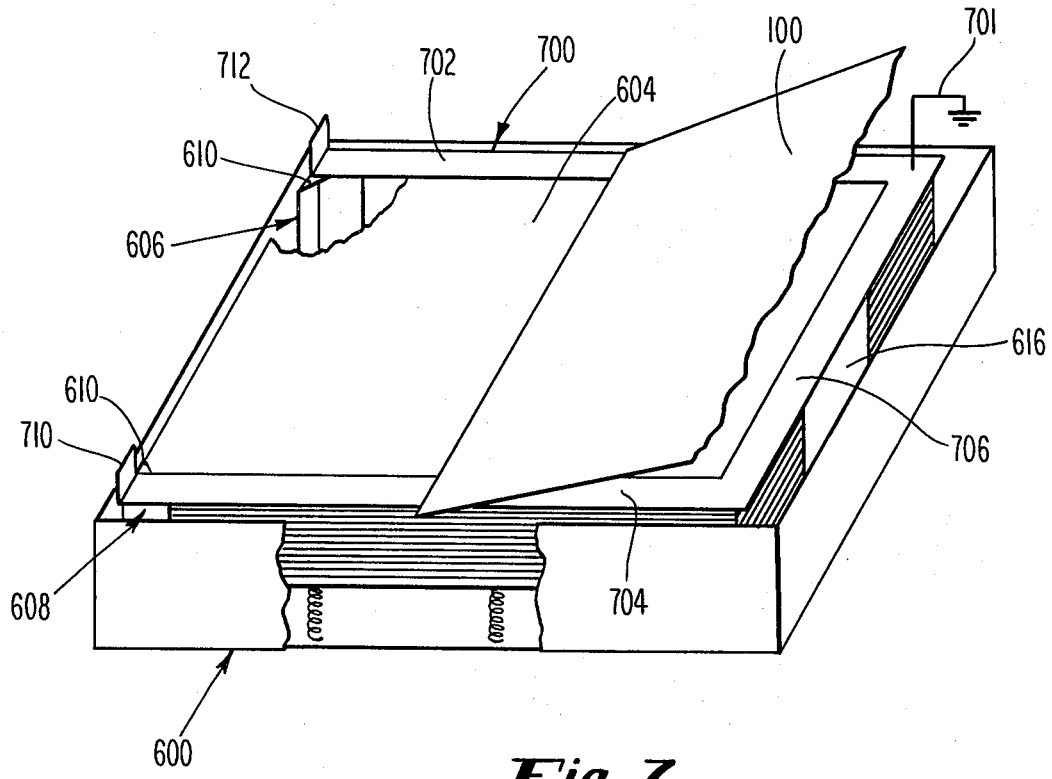
FIG. 7 is an alternate embodiment of the portion shown in FIG. 6.

In the preferred embodiment, when a cassette such as cassette 600 in FIG. 6 is used with the duplexing feature of the laser printer of FIG. 1 in paper feeding station 70, an additional device designated generally 700 in FIG. 7 is desirable. This device comprises a support frame comprising sides 702 and 704 which are linked together by connecting portion 706. Connecting portion 706 is appropriately supported so that the weight of device 700 does not fall on sheet 604 thereby increasing the frictional force between top sheet 604 and the sheet beneath. If device 700 were not supported in this manner additional friction might cause more than one sheet to be furnished to the transfer corotron 604 upon activation of roller 74 or would prevent the top sheet from being driven off by roller 76. In the description of FIG. 7 the connecting portion 706 is supported by the top section 618 of back guide 616. The back guide and sides of the cassette 600 also helps position device 700 on the cassette 600. At the opposite ends of the sides 702 and 704 from the connecting portion 706 are connected upright tabs 710 and 712. The ends of sides 702 and 704 where the upright tabs 710 and 712 are located are supported on the top sections 610 of corner guides 608 and 606. When a sheet of paper for duplex printing is deposited in paper cassette 600 along the return plate 100 the sides of the sheet of paper slide along sides 702 and 704 until the sheet of paper contacts upright tabs 710 and 712. This stops the sheet of paper from progressing any further into the laser printer mechanism. When it is desired to feed this sheet of paper to transfer corotron 604 the roller 704 is activated thereby engaging the sheet of paper which easily overcomes the upright tabs 710 and 712 and is fed through the paper feeding path into the mechanism. The upright tabs thereby provide separating means for separating the top sheet of paper from the remaining sheets in the cassette.

In some embodiments, the cassette 600 is made of an electrically non-conducting material such as plastic. In the duplex mode, many sheets can be deposited in the cassette from duplex roller assembly 102 causing an electrostatic build-up on the plastic cassette and sheets therein. This is due to the electrostatic charge on the papers which have passed through the printing mechanism for printing on one side. It has been found that because of the electrostatic build-up later sheets requiring duplex printing are not deposited fully in paper feeding station 70 causing subsequent misfeeds. The remedy is to make device 700 from an electrically conducting material such as metal and then grounding device 700 as indicated by line 701 in FIG. 7.

It should be understood that the device 700 need not rest on the cassette but could be connected to the printing mechanism housing or other support structure such that when the cassette was placed in the machine the device 700 would be disposed in close proximity to the cassette to function as described above, that is, to stop, position and separate the sheet for feeding back into the printing mechanism for duplex printing.

Figure 9:
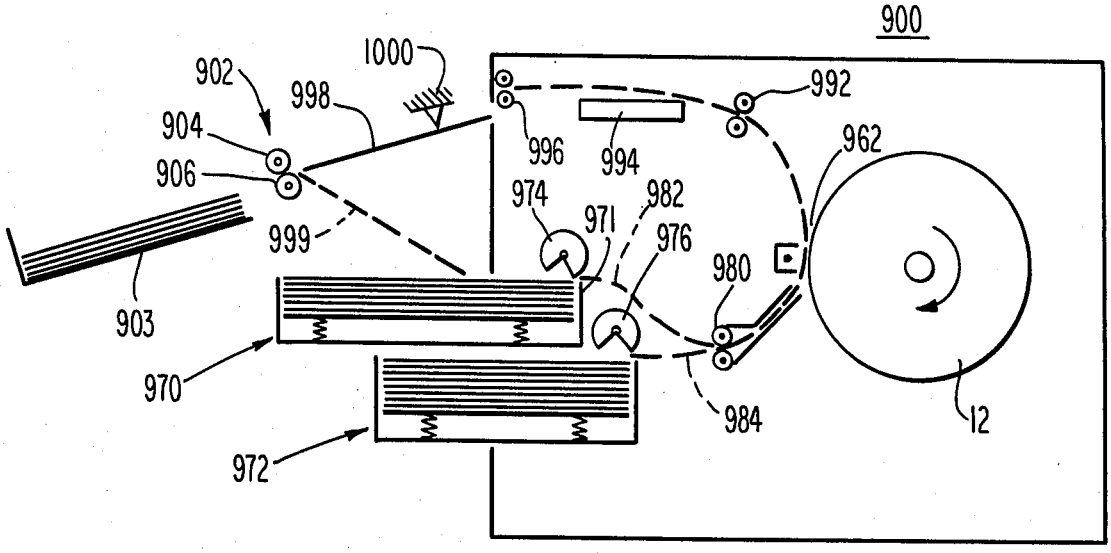
FIG. 9 is an alternate embodiment block diagram of the invention of FIG. 1.

FIG. 9 shows an alternate embodiment duplex printing mechanism designated generally 902 for use with a printing mechanism designated generally 900 such as a laser printer or plain paper copier. The printing mechanism 900 comprises two paper feeding stations designated generally 970 and 972. Paper feed rollers 974 and 976 can be activated in a manner as described in connection with FIG. 1 to furnish the top sheet of paper from the paper feeding station 970 and 972 respectively to a transfer station near the photoconducting drum 12. Roller 974 removes a sheet of paper along the dashed path 982 through pinch roller assembly 980. Similarly, roller 976 moves a sheet of paper along dashed path 984 through pinch roller assembly 980. Once past the transfer station 962 near the photoconducting drum 12 the sheet of paper follows dashed path 990 to the pinch roller assembly 992. From pinch roller assembly 992 the sheet of paper moves across heated plate 994 to the final pinch roller assembly 996. Note that in FIG. 9, the distance between pinch roller assembly 996 and paper feeding station 970 is larger than the same distance in FIG. 1. In FIG. 1, as the paper leaves pinch roller assembly 96 it falls a short distance to return plate 100 and is pushed up plate 100 to duplex roller assembly 102 by further rotation of roller assembly 96.

If the distance becomes too large between roller assembly 96 and return plate 100 (as it would be in FIG. 9) the sheet of paper could flip over on plate 100 and be forced down the plate 100 toward paper feeding station 70 instead of contacting duplex roller assembly 102.

Returning to FIG. 9, duplex roller assembly 902 comprises a pair of rollers 904 and 906 and a guide plate 998 which is attached to the top roller 904 in the preferred embodiment. As a sheet of paper leaves the printing mechanism 900 from the roller assembly 996 it engages the guide plate 998 and is guided to the pair of rollers 904 and 906. The distance between the pair of rollers 904 and 906 from the roller assembly 996 is less than the length of a sheet of paper for reasons described in connection with FIG. 1. If printing on the sheet of paper is finished, the sheet is discharged by continued rotation of the rollers 904 and 906 in the same direction. The paper is discharged into the paper output cassette 903 which is adjacent the pair of rollers 904 and 906. However, if duplex printing is required and the sheet of paper only has printing on one side then after the sheet of paper leaves the roller assembly 996, the direction of rotation of the pair of rollers 904 and 906 is reversed. When this happens the guide plate 998 attached to the roller 904 rotates to the dashed position 999 in FIG. 9. Also the sheet of paper engaged by the pair of rollers 904 and 906 moves down along the guide plate 999 into the paper feeding station 970 where it can be forwarded to the transfer station in the printing mechanism 900 for duplex printing.

After the sheet of paper has been deposited in the paper feeding station 970 the rotation of the pair of rollers 904 and 906 is again reversed and the guide plate 998 rotates to its former position against stop 1000. Now the duplex roller assembly 902 is ready to receive the next sheet of paper from roller assembly 996. This arrangement of connecting the guide plate 998 to the pair of rollers 904 and 906 and allowing it to rotate therewith allows the duplex printing mechanism to be adapted to a printing mechanism 900 wherein the distance between the output roller assembly 996 and the paper feeding station 970 is large enough to cause buckling when used with the arrangement of FIG. 1.

Figure 10:
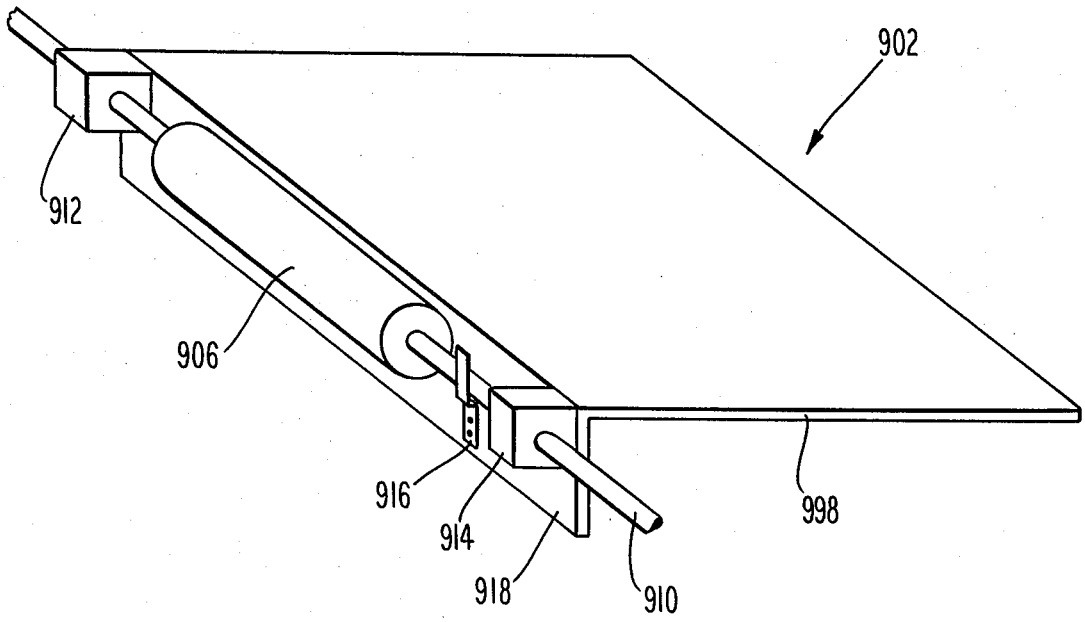
FIG. 10 is an enlarged perspective view of a portion of FIG. 9.

FIG. 9 shows a portion of the duplex roller assembly 902 in more detail. The paper guide plate 998 is attached to the shaft 910 of the bottom roller 906 by bearings 912 and 914. To add friction or drag between the paper guide plate 998 and shaft 910, a leaf spring 916 is attached to a downwardly extending portion 918 of the paper guide plate 998. The leaf spring 916 is spring loaded against the shaft 910. If the shaft is rotated in a clockwise direction, the guide plate 998 is forced to rotate in a clockwise direction until it hits a stop such as the stop 1000 in FIG. 9. When the guide plate 998 hits the stop, the shaft continues to rotate in bearings 912 and 914 with the spring 916 rubbing against the shaft. If the shaft 910 is now rotated in a counter clockwise direction, the paper guide plate 998 also moves counter clockwise until it again hits a stop such as the paper feeding station 970 at which point the shaft continues to rotate in bearings 912 and 914. The duplex roller assembly 902 may also include colors, C-rings, etc. which are not shown in FIG. 10 but which would be used to prevent the paper guide plate 998 from moving in a direction along the shaft.

As in the arrangement in FIG. 1, the distance between the front 971 of the paper feed station 970 and the duplex roller pair 904 and 906 is slightly greater than the length of a sheet of paper. This ensures that a page leaving the roller pair 904 and 906 is fed all the way into the paper feed station 970.

While the present invention has been disclosed in connection with the preferred embodiment thereof it should be understood that there may be other embodiments which fall within the spirit and scope of the invention as defined by the following claims.

We claim:

1. A laser printer for printing data on both sides of a sheet of paper comprising:

a light source for transmitting a collimated light beam along a path;

a light beam modulator disposed along said light beam path for modulating said light beam in response to modulation signals received from a data source;

optical means disposed along said light beam path for exposing a photosensitive member to said modulated light beam to image data thereon;

at least one transfer means disposed adjacent said photosensitive member for transferring said data image to one side of a sheet of paper;

at least one paper feeding station for holding a plurality of sheets of paper, said at least one paper feeding station and said transfer means lying along a paper feeding path;

paper feeding means for feeding a sheet of paper from said at least one paper feeding station and presenting said sheet of paper to said transfer means whereby data is transferred to a single side of said sheet;

at least one discharge station for holding sheets of paper on which printing is finished, said discharge station and said transfer means lying along a paper discharge path; and duplex means in close proximity to said at least one paper feeding station for discharging sheets of paper along a portion of said discharge path to said at least one discharge station when the printing on said sheets is furnished, and for depositing selected sheets of paper having data imaged on a first side and received from said transfer means into said at least one paper feeding station inverted from their original state in said paper feeding station, whereby said selected sheets are presented to said transfer means a second time for imaging of data on a second side of said selected sheets, said duplex means comprising a reversible propelling means for engaging and moving said sheets of paper, said reversible propelling means disposed intermediate said portion of said discharge path and said transfer means, wherein said laser printer prints data on first and second sides of a plurality of sheets of paper in a predetermined order by presenting each sheet of paper to a transfer means first and second times and wherein said data comprises pagination data for each of said plurality of sheets, said laser printer further comprising sensing means for sensing said pagination data and stopping said printer when the printing of said sheets of paper deviates from said predetermined order.

2. A duplex copying apparatus for copying images of original data onto both sides of a copy sheet of paper comprising:

a photosensitive surface for storing said images;

exposure means for exposing said photosensitive surface in accordance with said original data;

at least one transfer means for transferring said data image to one side of a sheet of paper;

at least one paper feeding station for holding a plurality of sheets of paper, said at least one paper feeding station and said transfer means lying along a paper feeding path;

at least one paper feeding means for feeding a sheet of paper from said at least one paper feeding station and presenting a sheet of said paper to said transfer means along said paper feeding path whereby data is transferred to one side of said sheet;

at least one discharge station for holding sheets of paper on which printing is finished, said discharge station and said transfer means lying along a paper discharge path; and duplex means in close proximity to said at least one paper feeding station for discharging sheets of paper along a portion of said discharge path to said discharge station when printing on said sheets is finished, and for depositing selected sheets of paper received from said transfer means into said at least one paper feeding station inverted from their original state in said paper feeding station, whereby said selected sheets are presented to said transfer means a second time for imaging of data on a second side of said selected sheets, said duplex means comprising a reversible propelling means for engaging and moving said sheets of paper, said reversible propelling means disposed intermediate said portion of said discharge path and said transfer means, wherein said duplex copying apparatus copies data on first and second sides of a plurality of sheets of paper in a predetermined order by presenting each sheet of paper to a transfer means first and second times and wherein said data comprises pagination data from each of said plurality of sheets, said duplex copying apparatus further comprising sensing means for sensing said pagination data and stopping said copier, when the copying of said sheets of paper deviates from said predetermined order.

3. The invention of claims 1 or 2 wherein said reversible propelling means is also disposed between said discharge station and said at least one paper feeding station.

4. The invention of claims 1 or 2 wherein said at least one paper feeding station comprises first and second paper feeding stations, and said duplex means is disposed in close proximity to said first paper feeding station and is disposed to deposit selected sheets of paper into said first paper feeding station inverted from their original state in said at least one paper feeding means.

5. The invention of claim 1 wherein said laser printer further comprises a stopping means in close proximity to said paper feeding station for stopping each of said selected sheets received from said duplex means in proper position for feeding a second time to said transfer station.

6. A laser printer for printing data on both sides of a sheet of paper comprising:

a light source for transmitting a collimated light beam along a path;

a light beam modulator disposed along said light beam path for modulating said light beam in response to modulation signals received from a data source;

optical means disposed along said light beam path for exposing a photosensitive member to said modulated light beam to image data thereon;

at least one transfer means disposed adjacent said photosensitive member for transferring said data image to one side of a sheet of paper;

at least one paper feeding station for holding a plurality of sheets of paper, said at least one paper feeding station and said transfer means lying along a paper feeding path;

paper feeding means for feeding a sheet of paper from said at least one paper feeding station and presenting said sheet of paper to said transfer means whereby data is transferred to a single side of said sheet;

at least one discharge station for holding sheets of paper on which printing is finished, said discharge station and said transfer means lying along a paper discharge path;

duplex means in close proximity to said at least one paper feeding station for discharging sheets of paper along a portion of said discharge path to said at least one discharge station when the printing on said sheets is finished, and for depositing selected sheets of paper having data imaged on a first side and received from said transfer means into said at least one paper feeding station inverted from their original state in said paper feeding station, whereby said selected sheets are presented to said transfer means a second time for imaging of data on a second side of said selected sheets, said duplex means comprising a reversible propelling means for engaging and moving said sheets of paper, said reversible propelling means disposed intermediate said portion of said discharge path and said transfer means, wherein said second side of said sheet of paper is printed on said sheet of paper during the first presentation to said transfer means and the first side during said second presentation and wherein said laser printer further comprises a discharge inverting means connected between said duplex means and said discharge station for inverting said sheets of paper when discharging whereby said plurality of said sheets of paper are accumulated in said predetermined proper order in said discharge station.

7. A paper handling device to handle paper sheets being transported to and from a printing apparatus, said paper handling device comprising in combination:

paper guide means which define part of a paper transport path;

first roller means disposed and formed to receive and positively pull a paper sheet leaving said printing apparatus, said first roller means further disposed to push said paper sheet through said paper guide means;

second roller means formed to selectively rotate in first and second directions and disposed to both pull said paper sheet from said paper guide means when rotating in said first direction and push said paper sheet into said paper guide means when rotating in said second direction;

first paper sheet receiving means formed and disposed to receive a paper sheet which has been pulled from said paper guide means by rotating said second roller means in said first direction and not returned there along by rotating said second roller in said second direction;

and second paper sheet receiving means formed and disposed to receive a paper sheet which has been pushed along said guide means by rotating said second roller means in said second direction, wherein said paper guide means is connected to a portion of said second roller means and partially rotatable therewith, said paper guide means movable to a first position between said first roller means and said second roller means when said second roller means rotates in said first direction and movable to a second position between said second paper sheet receiving means and said second roller means when said second roller means rotates in said second direction.

8. A duplex printing apparatus for printing on both sides of a sheet of paper comprising:

a first and a second sheet storage tray;

a discharge tray;

an image storage drum positioned to receive sheets of paper from either of said sheet storage trays;

first drawing roller means to selectively position sheets of paper from the sheet storage trays in contact with said drum so that the image stored thereon may be transferred to the first side of the selected sheets as they travel along a printing path past said drum;

reversible driving roller means positioned to finally receive the printed sheets from said drum and to deliver said sheets, in a predetermined manner, to said discharge tray when the reversible driving rollers are rotating in a first direction and to said first sheet storage tray when said driving rollers are rotating in a reverse direction for subsequent selective re-introduction in the printing path while turning it side for side in preparation for another pass past the image storage drum for transference of an image to its second side; and one of the reversible driving rollers includes a tray-like appendage which is moved between a first and a second position as the roller reverses direction.

* * * * *